US009926063B2

(12) United States Patent
Morota

(10) Patent No.: US 9,926,063 B2
(45) Date of Patent: Mar. 27, 2018

(54) JET PROPELLED WATERCRAFT AND JET PROPULSION ASSEMBLY

(71) Applicant: YAMAHA HATSUDOKI KABUSHIKI KAISHA, Iwata-shi, Shizuoka (JP)

(72) Inventor: Koichiro Morota, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/398,741

(22) Filed: Jan. 5, 2017

(65) Prior Publication Data

US 2017/0361913 A1 Dec. 21, 2017

(30) Foreign Application Priority Data

Jun. 17, 2016 (JP) ..... 2016-120642

(51) Int. Cl.
*B63H 21/32* (2006.01)
*B63H 11/02* (2006.01)

(52) U.S. Cl.
CPC ..... *B63H 21/32* (2013.01); *B63H 11/02* (2013.01); *B63B 2751/00* (2013.01)

(58) Field of Classification Search
CPC ..... B63H 21/32; B63H 11/02; B63B 35/73; F01N 3/04; F01N 3/28; F01N 11/00; F01N 13/00
USPC ..... 440/89 H, 89 R
See application file for complete search history.

(56) References Cited

U.S. PATENT DOCUMENTS

| | | | |
|---|---|---|---|
| 5,702,276 | A | 12/1997 | Nakase et al. |
| 6,213,827 | B1 | 4/2001 | Hattori et al. |
| 2010/0261392 | A1 | 10/2010 | Ozawa |
| 2016/0017840 | A1 | 1/2016 | Harada |
| 2016/0031538 | A1 | 2/2016 | Harada |
| 2016/0031539 | A1 | 2/2016 | Terada et al. |

FOREIGN PATENT DOCUMENTS

| | | | |
|---|---|---|---|
| JP | 8-296432 | A | 11/1996 |
| JP | 11-245895 | A | 9/1999 |
| JP | 2010-241333 | A | 10/2010 |
| JP | 2016-23585 | A | 2/2016 |
| JP | 2016-34794 | A | 3/2016 |
| JP | 2016-34796 | A | 3/2016 |

*Primary Examiner* — Lars A Olson
(74) *Attorney, Agent, or Firm* — Keating and Bennett, LLP

(57) ABSTRACT

A jet propelled watercraft includes a first exhaust pipe connected to an exhaust port, a catalyst storage connected to the first exhaust pipe, a second exhaust pipe connected to the catalyst storage, and a water lock connected to the second exhaust pipe. The catalyst storage and the water lock are located outward in a width direction with respect to the exhaust port of the engine in a plan view of the jet propelled watercraft.

18 Claims, 4 Drawing Sheets

CROSS-SECTION ALONG LINE I-I

JET PROPELLED WATERCRAFT AND JET PROPULSION ASSEMBLY

CROSS-REFERENCE TO RELATED APPLICATION

This application claims priority to Patent Application No. 2016-120642 filed in Japan on Jun. 17, 2016, the entire contents of which are hereby incorporated herein by reference.

BACKGROUND OF THE INVENTION

1. Field of the Invention

The present invention relates to a jet propelled watercraft and a jet propulsion assembly, and more particularly, it relates to a jet propelled watercraft and a jet propulsion assembly each including a water lock.

2. Description of the Related Art

A jet propelled watercraft including a water lock is known in general. Such a jet propelled watercraft including a water lock is disclosed in Japanese Patent Laid-Open No. 11-245895, for example.

Japanese Patent Laid-Open No. 11-245895 discloses a small watercraft (jet propelled watercraft) including an engine, a catalyst, and a water lock. In this small watercraft, exhaust gas discharged from the engine is guided to the water lock through the catalyst. In this small watercraft, the catalyst is located on a first side in a width direction perpendicular to the longitudinal direction of a watercraft body with respect to the engine. Furthermore, in this small watercraft, the water lock is located on a second side in the width direction of the watercraft body with respect to the engine.

In the small watercraft described in Japanese Patent Laid-Open No. 11-245895, the catalyst is located on the first side in the width direction of the watercraft body with respect to the engine while the water lock is located on the second side in the width direction of the watercraft body with respect to the engine, and hence the size of the watercraft body in the width direction is increased, as in the small watercraft described in Japanese Patent Laid-Open No. 11-245895.

SUMMARY OF THE INVENTION

Preferred embodiments of the present invention provide a jet propelled watercraft and a jet propulsion assembly that significantly reduce or prevent an increase in the size of a watercraft body in a width direction.

A jet propelled watercraft according to a preferred embodiment of the present invention includes a watercraft body, an engine housed in the watercraft body and provided with an exhaust port on a side surface in a width direction that is perpendicular to a longitudinal direction of the watercraft body, a first exhaust pipe connected to the exhaust port, a catalyst storage connected to the first exhaust pipe, a second exhaust pipe connected to the catalyst storage, and a water lock connected to the second exhaust pipe. The catalyst storage overlaps with the side surface of the engine in a side view, and the catalyst storage and the water lock are located outward in the width direction with respect to the exhaust port of the engine in a plan view.

In a jet propelled watercraft according to a preferred embodiment of the present invention, the catalyst storage and the water lock are located outward in the width direction with respect to the exhaust port of the engine in the plan view. Thus, both the catalyst storage and the water lock are located only on one side in the width direction of the watercraft body with respect to the engine (outward in the width direction with respect to the exhaust port). Consequently, the size in the width direction of a region in which the engine, the catalyst storage, and the water lock are located is reduced as compared with the case where the catalyst storage and the water lock are located on both sides in the width direction with respect to the engine, respectively, and hence an increase in the size of the watercraft body in the width direction is significantly reduced or prevented. Furthermore, in this structure, the catalyst storage and the water lock are located on one side in the width direction of the watercraft body with respect to the engine (outward in the width direction with respect to the exhaust port), and hence the length of the exhaust pipe (second exhaust pipe) that connects the catalyst storage to the water lock is reduced as compared with the case where the catalyst storage and the water lock are located on both sides in the width direction with respect to the engine, respectively. Consequently, an increase in the weight of the exhaust pipe (second exhaust pipe) that connects the catalyst storage to the water lock is significantly reduced or prevented. Thus, an increase in the weight of the watercraft body is significantly reduced or prevented.

Furthermore, in a jet propelled watercraft according to a preferred embodiment of the present invention, the catalyst storage overlaps with the side surface of the engine in the side view. Thus, an increase in the size of the watercraft body in a vertical direction or the longitudinal direction is significantly reduced or prevented as compared with the case where the catalyst storage is totally outside of the side surface of the engine in the side view. Furthermore, in this structure, the catalyst storage is located closer to the exhaust port as compared with the case where the catalyst storage is totally outside of the side surface of the engine in the side view. Consequently, the length of the exhaust pipe (first exhaust pipe) that connects the exhaust port to the catalyst storage is reduced. Thus, an increase in the weight of the exhaust pipe (first exhaust pipe) that connects the exhaust port to the catalyst storage is significantly reduced or prevented, and hence an increase in the weight of the watercraft body is significantly reduced or prevented.

In a jet propelled watercraft according to a preferred embodiment of the present invention, the first exhaust pipe and the second exhaust pipe preferably overlap with the side surface of the engine in the side view. Accordingly, in addition to the catalyst storage, the first exhaust pipe and the second exhaust pipe overlap with the side surface of the engine in the side view, and hence an increase in the size of the watercraft body in the vertical direction or the longitudinal direction is effectively significantly reduced or prevented.

In a jet propelled watercraft according to a preferred embodiment of the present invention, the exhaust port preferably includes a plurality of exhaust ports provided on the side surface of the engine, and the catalyst storage is preferably located forward relative to a back end of a rearward most exhaust port of the plurality of exhaust ports and rearward relative to a front end of a forward most exhaust port of the plurality of exhaust ports. Accordingly, the catalyst storage is located close to the exhaust port. As used herein, "close to"indicates adjacent to or in a vicinity of. Consequently, the length of the exhaust pipe (first exhaust pipe) that connects the exhaust port to the catalyst storage is further reduced such that an increase in the weight of the exhaust pipe (first exhaust pipe) that connects the exhaust port to the catalyst storage is further significantly reduced or prevented. Consequently, an increase in the weight of the watercraft body is further significantly reduced or prevented.

In a jet propelled watercraft according to a preferred embodiment of the present invention, the first exhaust pipe preferably includes a bent portion that extends forward of the exhaust port, is bent back, and extends rearward. Accordingly, the first exhaust pipe extends forward and thereafter extends rearward due to the bent portion, and hence the first exhaust pipe and the catalyst storage are connected to each other at a position that is farther forward as compared with the case where the first exhaust pipe extends only rearward of the exhaust port. Consequently, the catalyst storage is located at a more forward position, and hence the catalyst storage is easily located at a position at which the catalyst storage overlaps with the side surface of the engine.

In this case, the exhaust port preferably includes a plurality of exhaust ports provided on the side surface of the engine, and the bent portion of the first exhaust pipe preferably extends forward of a forward most exhaust port of the plurality of exhaust ports, is bent back, and extends rearward. Accordingly, even in a structure in which the plurality of exhaust ports are provided on the side surface of the engine, the catalyst storage is located forward such that the catalyst storage is easily located at the position at which the catalyst storage overlaps with the side surface of the engine.

In a structure in which the first exhaust pipe includes the bent portion, the bent portion preferably overlaps with the side surface of the engine in the side view. Accordingly, the bent portion is provided such that an increase in the size of the watercraft body in the vertical direction or the longitudinal direction is significantly reduced or prevented.

In a structure in which the first exhaust pipe includes the bent portion, the bent portion is preferably bent back near a front end of the engine. Accordingly, the length of the bent portion of the first exhaust pipe is reduced as compared with the case where the bent portion of the first exhaust pipe is bent back at a forward position relative to a front end of the engine. Consequently, an increase in the weight of the first exhaust pipe is significantly reduced or prevented. Thus, an increase in the weight of the watercraft body is significantly reduced or prevented.

In a structure in which the first exhaust pipe includes the bent portion, a portion of the bent portion before being bent back and a portion of the bent portion after being bent back preferably overlap with each other in the side view. Accordingly, the portion of the bent portion before bending back and the portion of the bent portion after bending back are located close to each other, and hence the length of the bent portion is reduced. Consequently, an increase in the weight of the first exhaust pipe is significantly reduced or prevented. Thus, an increase in the weight of the watercraft body is significantly reduced or prevented.

In a structure in which the first exhaust pipe includes the bent portion, the first exhaust pipe preferably further includes a lead-out portion that connects the exhaust port of the engine to the bent portion and an increased diameter portion that connects the bent portion to the catalyst storage, and the lead-out portion, the bent portion, and the increased diameter portion are preferably integral and unitary with each other. Accordingly, the number of components of an exhaust passage is reduced as compared with the case where at least one of the lead-out portion, the bent portion, and the increased diameter portion is separately provided. Consequently, the structure of the exhaust passage is simplified.

In a jet propelled watercraft according to a preferred embodiment of the present invention, the catalyst storage is preferably integral and unitary with the first exhaust pipe. Accordingly, the number of components of the exhaust passage is reduced as compared with the case where the catalyst storage is provided separately from the first exhaust pipe. Consequently, the structure of the exhaust passage is simplified.

In a jet propelled watercraft according to a preferred embodiment of the present invention, a bottom of an exhaust gas passage of the first exhaust pipe is preferably located below the exhaust port. Accordingly, when moisture in the exhaust gas is condensed to generate condensed water, accumulation of the condensed water between the exhaust port and the first exhaust pipe is significantly reduced or prevented. Consequently, blockage of the exhaust gas flow caused by the accumulation of the condensed water is significantly reduced or prevented.

In this case, a bottom of an exhaust gas passage of the catalyst storage is preferably located at a same or substantially a same height as the bottom of the exhaust gas passage of the first exhaust pipe or is preferably located below the bottom of the exhaust gas passage of the first exhaust pipe, a bottom of an exhaust gas passage of the second exhaust pipe is preferably located at a same or substantially a same height as the bottom of the exhaust gas passage of the catalyst storage or is preferably located below the bottom of the exhaust gas passage of the catalyst storage, and a bottom of an exhaust gas passage of the water lock is preferably located at a same or substantially a same height as the bottom of the exhaust gas passage of the second exhaust pipe or is preferably located below the bottom of the exhaust gas passage of the second exhaust pipe. Accordingly, a rising slope in the exhaust passage from the exhaust port to the water lock is significantly reduced or prevented. Consequently, accumulation of the condensed water between the exhaust port and the water lock is significantly reduced or prevented. Thus, blockage of the exhaust gas flow caused by the accumulation of the condensed water is significantly reduced or prevented. Furthermore, a degradation of the performance of a catalyst in the catalyst storage caused by a decrease in the temperature of the catalyst resulting from the accumulation of the condensed water is significantly reduced or prevented.

In a jet propelled watercraft according to a preferred embodiment of the present invention, an upper end of the catalyst storage and an upper end of the water lock are preferably located below an upper end of the engine in the side view, and a lower end of the catalyst storage and a lower end of the water lock are preferably located above a lower end of the engine in the side view. Accordingly, an increase in the size of the watercraft body in the vertical direction is significantly reduced or prevented as compared with the case where the upper ends of the catalyst storage and the water lock are located below the lower end of the engine or the lower ends of the catalyst storage and the water lock are located above the upper end of the engine.

In a jet propelled watercraft according to a preferred embodiment of the present invention, the catalyst storage preferably overlaps with the first exhaust pipe in the side view. Accordingly, the catalyst storage and the first exhaust pipe are located close to each other, and hence the length of the first exhaust pipe is reduced. Consequently, an increase in the weight of the first exhaust pipe is significantly reduced or prevented. Thus, an increase in the weight of the watercraft body is significantly reduced or prevented.

In this case, a portion of a side surface of the catalyst storage and a portion of a side surface of the first exhaust pipe are preferably integral and unitary with each other. Accordingly, the catalyst storage is located close to the exhaust port, and hence an increase in the size of the watercraft body in the width direction is further significantly reduced or prevented. Furthermore, in this structure, the catalyst storage and the first exhaust pipe are located close to each other, and hence the length of the first exhaust pipe is further reduced such that an increase in the weight of the first exhaust pipe is further significantly reduced or prevented. Consequently, an increase in the weight of the watercraft body is further significantly reduced or prevented.

A jet propulsion assembly according to a preferred embodiment of the present invention includes an engine housed in a watercraft body and provided with an exhaust port on a side surface in a width direction perpendicular to a longitudinal direction of the watercraft body, a first exhaust pipe connected to the exhaust port, a catalyst storage connected to the first exhaust pipe, a second exhaust pipe connected to the catalyst storage, and a water lock connected to the second exhaust pipe. The catalyst storage overlaps with the side surface of the engine in a side view, and the catalyst storage and the water lock are located outward in the width direction with respect to the exhaust port of the engine in a plan view.

In a jet propulsion assembly according to a preferred embodiment of the present invention, the catalyst storage and the water lock are located outward in the width direction with respect to the exhaust port of the engine in the plan view. Thus, both the catalyst storage and the water lock are located only on one side in the width direction of the watercraft body with respect to the engine (outward in the width direction with respect to the exhaust port). Consequently, the size in the width direction of a region in which the engine, the catalyst storage, and the water lock are located is reduced as compared with the case where the catalyst storage and the water lock are located on both sides in the width direction with respect to the engine, respectively, and hence an increase in the size of the watercraft body in the width direction is significantly reduced or prevented. Furthermore, in this structure, the catalyst storage and the water lock are located on one side in the width direction of the watercraft body with respect to the engine (outward in the width direction with respect to the exhaust port), and hence the length of the exhaust pipe (second exhaust pipe) that connects the catalyst storage to the water lock is reduced as compared with the case where the catalyst storage and the water lock are located on both sides in the width direction with respect to the engine, respectively. Consequently, an increase in the weight of the exhaust pipe (second exhaust pipe) that connects the catalyst storage to the water lock is significantly reduced or prevented. Thus, an increase in the weight of the watercraft body is significantly reduced or prevented.

Furthermore, in a jet propulsion assembly according to a preferred embodiment of the present invention, the catalyst storage overlaps with the side surface of the engine in the side view. Thus, an increase in the size of the watercraft body in a vertical direction or the longitudinal direction is significantly reduced or prevented as compared with the case where the catalyst storage is totally outside of the side surface of the engine in the side view. Furthermore, in this structure, the catalyst storage is located closer to the exhaust port as compared with the case where the catalyst storage is totally outside of the side surface of the engine in the side view. Consequently, the length of the exhaust pipe (first exhaust pipe) that connects the exhaust port to the catalyst storage is reduced. Thus, an increase in the weight of the exhaust pipe (first exhaust pipe) that connects the exhaust port to the catalyst storage is significantly reduced or prevented, and hence an increase in the weight of the watercraft body is significantly reduced or prevented.

In a jet propulsion assembly according to a preferred embodiment of the present invention, the first exhaust pipe and the second exhaust pipe preferably overlap with the side surface of the engine in the side view. Accordingly, in addition to the catalyst storage, the first exhaust pipe and the second exhaust pipe overlap with the side surface of the engine in the side view, and hence an increase in the size of the watercraft body in the vertical direction or the longitudinal direction is effectively significantly reduced or prevented.

In a jet propulsion assembly according to a preferred embodiment of the present invention, the exhaust port preferably includes a plurality of exhaust ports provided on the side surface of the engine, and the catalyst storage is preferably located forward relative to a back end of a rearward most exhaust port of the plurality of exhaust ports and rearward relative to a front end of a forward most exhaust port of the plurality of exhaust ports. Accordingly, the catalyst storage is located close to the exhaust port. Consequently, the length of the exhaust pipe (first exhaust pipe) that connects the exhaust port to the catalyst storage is further reduced such that an increase in the weight of the exhaust pipe (first exhaust pipe) that connects the exhaust port to the catalyst storage is further significantly reduced or prevented. Consequently, an increase in the weight of the watercraft body is further significantly reduced or prevented.

In a jet propulsion assembly according to a preferred embodiment of the present invention, the first exhaust pipe preferably includes a bent portion that extends forward of the exhaust port, is bent back, and extends rearward. Accordingly, the first exhaust pipe extends forward and thereafter extends rearward due to the bent portion, and hence the first exhaust pipe and the catalyst storage are connected to each other at a position that is farther forward as compared with the case where the first exhaust pipe extends only rearward of the exhaust port. Consequently, the catalyst storage is located at a more forward position, and hence the catalyst storage is easily located at a position at which the catalyst storage overlaps with the side surface of the engine.

In this case, the exhaust port preferably includes a plurality of exhaust ports provided on the side surface of the engine, and the bent portion of the first exhaust pipe preferably extends forward of a forward most exhaust port of the plurality of exhaust ports, is bent back, and extends rearward. Accordingly, even in a structure in which the plurality of exhaust ports are provided on the side surface of the engine, the catalyst storage is located forward such that the catalyst storage is easily located at the position at which the catalyst storage overlaps with the side surface of the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings. In the following description, a front-back direction, a vertical direction, and a right-left direction are directions relative to a jet propelled watercraft 1. More specifically, the forward movement direction (along arrow FWD) of the jet propelled watercraft 1 is a front side, and the backward movement direction (along arrow BWD) of the jet propelled watercraft 1 is a rear side. A right side with respect to the forward movement direction of the jet propelled watercraft 1 is the right, and a left side with respect to the forward movement direction of the jet propelled watercraft 1 is the left. In the following description, the front-back direction is also referred to as the longitudinal direction of a watercraft body 2, and the right-left direction is also referred to as the width direction of the watercraft body 2.

The structure of the jet propelled watercraft 1 according to a preferred embodiment of the present invention is now described with reference to FIGS. 1 to 7.

Figure 1:
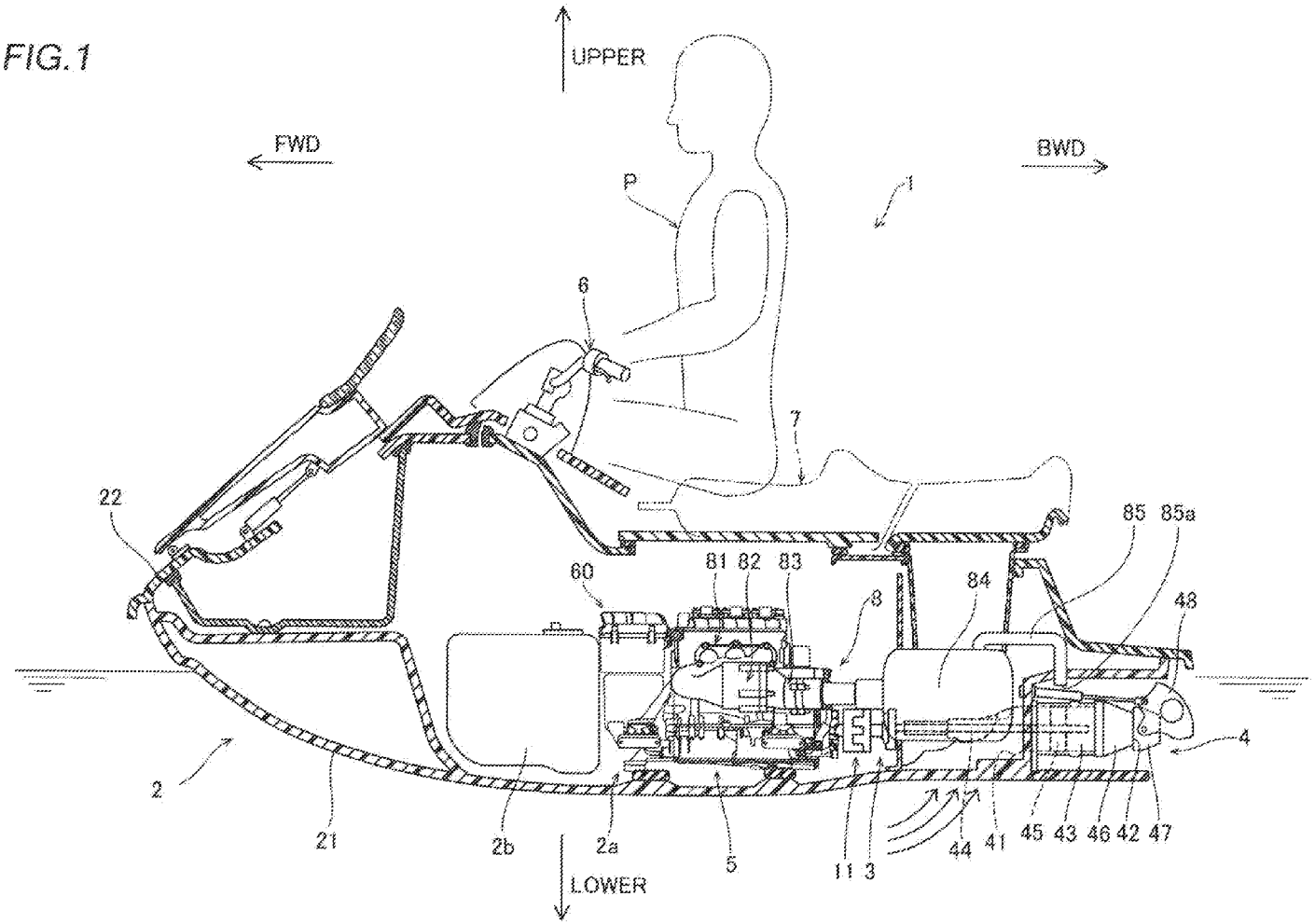
FIG. 1 is a diagram showing a jet propelled watercraft according to a preferred embodiment of the present invention.

As shown in FIG. 1, the jet propelled watercraft 1 includes the watercraft body 2 and a jet propulsion assembly (jet propulsion mechanism) 3. The jet propulsion assembly 3 includes a jet propulsion unit 4 and an engine 5. The jet propelled watercraft 1 includes a handle 6 and a seat 7. The handle 6 is operated to the right and left by a crew member P. The crew member P sits on the seat 7.

The watercraft body 2 includes a hull 21 that floats on the surface of the water and a deck 22 located above the surface of water. The deck 22 is located above the hull 21 including a watercraft bottom. The engine 5 is located between the hull 21 and the deck 22 in the vertical direction. The engine 5 is housed in an engine room 2*a* provided inside the watercraft body 2. In the engine room 2*a*, a fuel tank 2*b* is also housed. The jet propulsion unit 4 is located behind the engine 5. The seat 7 is located above the engine 5. The handle 6 is located in front of a seating surface of the seat 7. The handle 6 and the seat 7 are located above the watercraft body 2.

The jet propulsion unit 4 suctions and jets water with the drive force of the engine 5. The jet propulsion unit 4 includes a water inlet 41, a water outlet 42, and a flow passage 43. The water inlet 41 is open at the watercraft bottom. The water suctioned through the water inlet 41 is jetted rearward from the water outlet 42. The water suctioned through the water inlet 41 is guided to the water outlet 42 through the flow passage 43.

The jet propulsion unit 4 includes a drive shaft 44, an impeller 45, a nozzle 46, a deflector 47, and a bucket 48. A front end of the drive shaft 44 is located in the engine room 2*a*. A back end of the drive shaft 44 is located in the flow passage 43. The front end of the drive shaft 44 is mounted to the engine 5 through a coupling 11. The impeller 45 is mounted in the vicinity of the back end of the drive shaft 44. The impeller 45 is located in the flow passage 43. The impeller 45 rotates with the rotation of the drive shaft 44.

The nozzle 46 includes the water outlet 42. The nozzle 46 is located behind the impeller 45. The deflector 47 is mounted on the nozzle 46. The deflector 47 is located behind the nozzle 46. The deflector 47 rotates in the right-left direction with respect to the nozzle 46 about an axis that extends in the vertical direction. Thus, the deflector 47 changes the direction of the water jetted from the nozzle 46 in the right-left direction. The deflector 47 rotates in the right-left direction in response to operation of the handle 6. The bucket 48 is located behind the deflector 47. The bucket 48 rotates in the vertical direction with respect to the deflector 47 about an axis that extends in the right-left direction. Thus, the bucket 48 changes the direction of the water jetted from the deflector 47 to the forward direction or the rearward direction. The bucket 48 rotates in the vertical direction in response to operation of a shift lever (not shown).

The crew member P operates a throttle lever (not shown) provided on the handle 6 to adjust the output of the engine 5. When the engine 5 rotates the drive shaft 44, the impeller 45 is rotated with the drive shaft 44. Consequently, a force to suction water outside the watercraft into the flow passage 43 through the water inlet 41 is generated. The water suctioned into the flow passage 43 passes through the impeller 45, the nozzle 46, and the deflector 47, in this order, and is jetted rearward from the deflector 47. Thus, a thrust to propel the jet propelled watercraft 1 is generated. The direction of the water jetted from the deflector 47 is changed in the right-left direction by the rotation of the deflector 47 in the right-left direction in response to operation of the handle 6. The direction of the water jetted from the deflector 47 is changed from the forward direction to the rearward direction by the rotation of the bucket 48 in a downward direction in response to operation of the shift lever, and is changed from the rearward direction to the forward direction by the rotation of the bucket 48 in an upward direction in response to operation of the shift lever. Consequently, the jet propelled watercraft 1 is steered.

Figure 2:
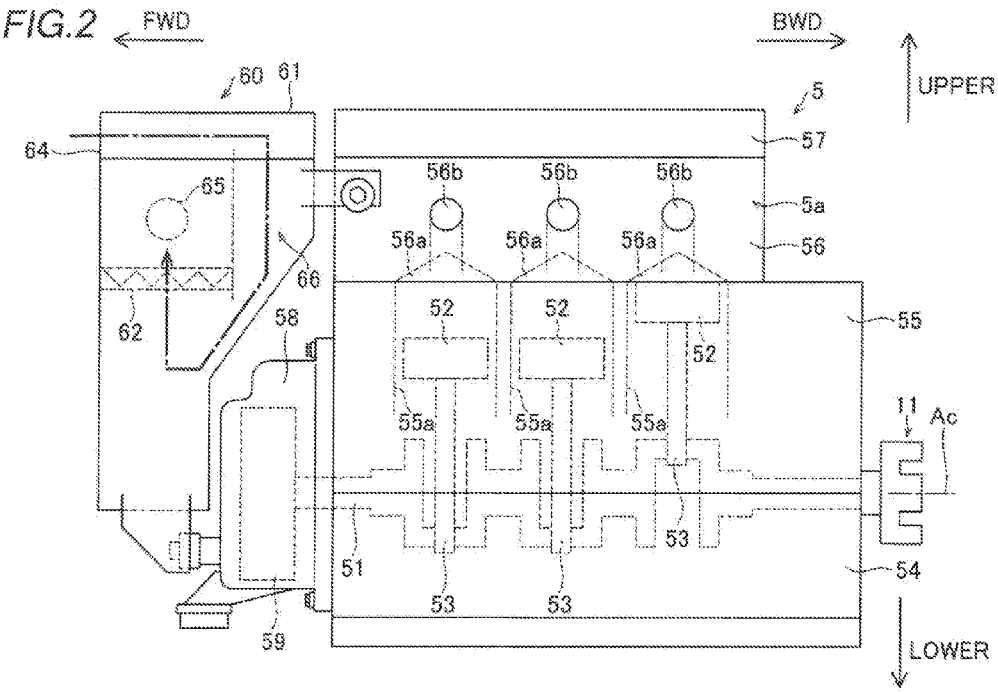
FIG. 2 is a side elevational view schematically showing an engine of a jet propelled watercraft according to a preferred embodiment of the present invention.

As shown in FIG. 2, the engine 5 is an internal combustion engine. The engine 5 is preferably an in-line engine. The engine 5 includes a crankshaft 51, a plurality of (for example, three in a preferred embodiment of the present invention) pistons 52, and a plurality of (for example, three in a preferred embodiment of the present invention) connecting rods 53. The crankshaft 51 is rotatable about the axis Ac of the crankshaft that extends in the front-back direction. A back end of the crankshaft 51 is mounted to the jet propulsion unit 4 (see FIG. 1) through the coupling 11. A front end of the crankshaft 51 is mounted to a power generator 59 described below. Each of the pistons 52 reciprocates in the vertical direction according to the rotation of the crankshaft 51. Each of the connecting rods 53 couples a corresponding piston 52 to the crankshaft 51.

Figure 3:
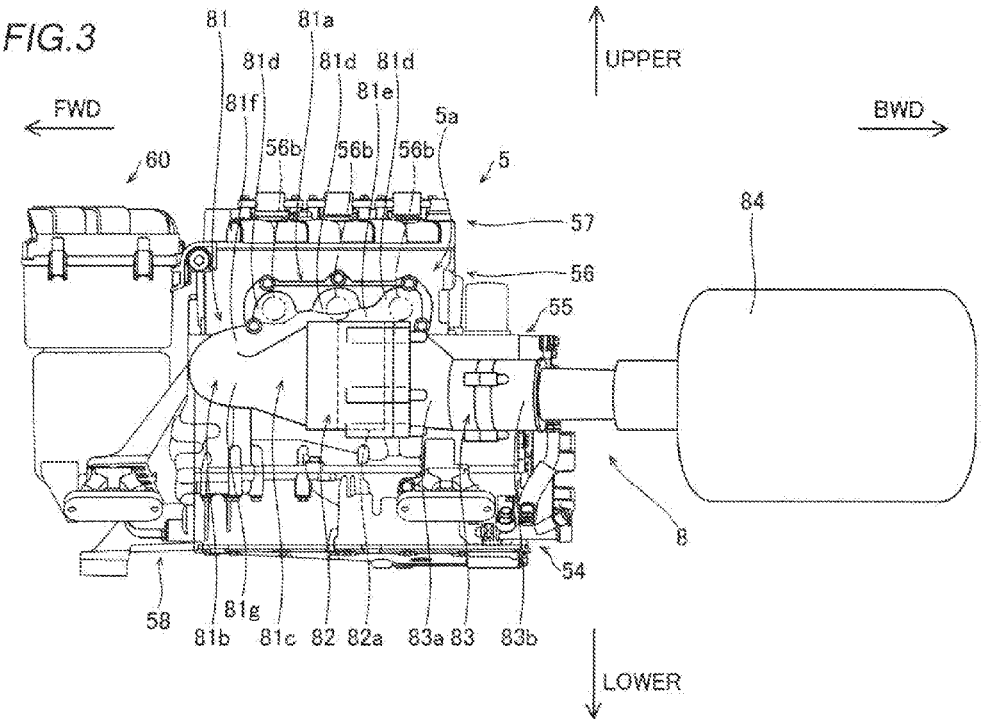
FIG. 3 is a side elevational view showing an engine of a jet propelled watercraft according to a preferred embodiment of the present invention.

As shown in FIGS. 2 and 3, the engine 5 includes a crank case 54, a cylinder body 55, a cylinder head 56, and a cylinder head cover 57. The crank case 54 as well as the cylinder body 55 houses the crankshaft 51. The cylinder body 55 is provided with a plurality of (for example, three in a preferred embodiment of the present invention) cylinders 55*a* that contain the plurality of pistons 52, respectively. The cylinder head 56 is provided with a plurality of (for example, three in a preferred embodiment of the present invention) combustion chambers 56*a*, a plurality of (for example, three in a preferred embodiment of the present invention) exhaust ports 56*b*, and a plurality of intake ports (not shown). The plurality of exhaust ports 56*b* are provided on a side surface 5*a* of the engine 5 in the width direction perpendicular to the longitudinal direction (front-back direction) of the watercraft body 2. The side surface 5*a* includes side surfaces of the crank case 54, the cylinder body 55, the cylinder head 56, and the cylinder head cover 57. The plurality of exhaust ports 56*b* are aligned in the front-back direction. The cylinder head cover 57 covers the cylinder head 56. The crank case 54, the cylinder body 55, the cylinder head 56, and the cylinder head cover 57 are aligned in the vertical direction, in this order, from the bottom.

In the jet propulsion assembly 3, a case cover 58 is mounted on the engine 5. The case cover 58 is located below the cylinder head 56. The case cover 58 is located in front of the crank case 54 and the cylinder body 55. The case cover 58 houses the power generator 59. The power generator 59 converts the power of the engine 5 to electric power by the relative rotation of a rotor (not shown) with respect to a stator (not shown) due to the rotation of the crankshaft 51.

The jet propulsion assembly 3 includes an air intake apparatus 60. The air intake apparatus 60 is mounted to the engine 5. The air intake apparatus 60 is located in front of the engine 5 and on the right of the engine 5. The air intake apparatus 60 includes an air intake box 61, an air filter 62, and an intake pipe 63 (see FIG. 4). The air intake box 61 stores the air filter 62. The air filter 62 removes extraneous material in the air. The intake pipe 63 guides air discharged from the air intake box 61 to the plurality of combustion chambers 56*a* through the intake ports.

The air intake box 61 includes an air intake inlet 64, an air intake outlet 65, and an air intake passage 66. The air intake inlet 64 is opened at a front upper portion of the air intake box 61. The air suctioned through the air intake inlet 64 is discharged from the air intake outlet 65. The air intake outlet 65 is connected to the intake pipe 63. The air intake passage 66 connects the air intake inlet 64 to the air intake outlet 65. In FIG. 2, the air flow is shown by a thick one-dot chain line.

As shown in FIGS. 1 and 3 to 6, the jet propulsion assembly 3 includes an exhaust passage 8. The exhaust passage 8 is mounted to the engine 5. Exhaust gas discharged from the plurality of exhaust ports 56*b* is discharged outward of the watercraft body 2 through the exhaust passage 8. The exhaust passage 8 includes a first exhaust pipe 81, a catalyst storage 82, a second exhaust pipe 83, a water lock 84, and a third exhaust pipe 85 (see FIG. 1).

The exhaust gas discharged from the exhaust ports 56*b* is led out through the first exhaust pipe 81. The catalyst storage 82 stores a catalyst member 82*a* (see FIGS. 3 and 4) that enhances the reaction of a component (such as HC, CO, or NOx) contained in the exhaust gas. The second exhaust pipe 83 guides the exhaust gas passing through the catalyst storage 82 to the water lock 84. The water lock 84 significantly reduces or prevents inflow, toward the engine 5, of water entering from an exhaust opening 85*a* (see FIG. 1) through which the exhaust gas is externally discharged. The third exhaust pipe 85 discharges the exhaust gas discharged from the exhaust ports 56*b* outward of the watercraft body 2 (into water).

An upstream portion of the first exhaust pipe 81 in the flow direction of the exhaust gas is connected to the exhaust ports 56*b*. A downstream portion of the first exhaust pipe 81 in the flow direction of the exhaust gas is connected to the catalyst storage 82. An upstream portion of the catalyst storage 82 in the flow direction of the exhaust gas is connected to the first exhaust pipe 81. A downstream portion of the catalyst storage 82 in the flow direction of the exhaust gas is connected to the second exhaust pipe 83. An upstream portion of the second exhaust pipe 83 in the flow direction of the exhaust gas is connected to the catalyst storage 82. A downstream portion of the second exhaust pipe 83 in the flow direction of the exhaust gas is connected to the water lock 84. An upstream portion of the water lock 84 in the flow direction of the exhaust gas is connected to the second exhaust pipe 83. A downstream portion of the water lock 84 in the flow direction of the exhaust gas is connected to the third exhaust pipe 85. An upstream portion of the third exhaust pipe 85 in the flow direction of the exhaust gas is connected to the water lock 84. A downstream end of the third exhaust pipe 85 in the flow direction of the exhaust gas is opened outward of the watercraft body 2. The downstream end of the third exhaust pipe 85 includes the exhaust opening 85*a*. In the exhaust passage 8, the exhaust gas passes through the first exhaust pipe 81, the catalyst storage 82, the second exhaust pipe 83, the water lock 84, and the third exhaust pipe 85, in this order, and is discharged outward of the watercraft body 2.

The first exhaust pipe 81 includes a lead-out portion 81*a*, a bent portion 81*b*, and an increased diameter portion 81*c*. An upstream portion of the lead-out portion 81*a* in the flow direction of the exhaust gas is connected to the exhaust ports 56*b*. A downstream portion of the lead-out portion 81*a* in the flow direction of the exhaust gas is connected to the bent portion 81*b*. The lead-out portion 81*a* includes a plurality of (for example, three in a preferred embodiment of the present invention) branches 81*d* and a trunk 81*e*. The plurality of branches 81*d* are aligned in the front-back direction. Each of the branches 81*d* is connected to a corresponding exhaust port 56*b*. The trunk 81*e* connects the plurality of branches 81*d* to each other. In the trunk 81*e*, the exhaust gas to be led out from the exhaust ports 56*b* through the branches 81*d* is gathered. The trunk 81*e* extends in the front-back direction.

An upstream portion of the bent portion 81*b* in the flow direction of the exhaust gas is connected to the lead-out portion 81*a*. A downstream portion of the bent portion 81*b* in the flow direction of the exhaust gas is connected to the increased diameter portion 81*c*. The bent portion 81*b* extends forward of a forward most exhaust port 56*b* of the plurality of exhaust ports 56*b*, is bent back, and extends rearward. A portion 81*f* of the bent portion 81*b* before being bent and a portion 81*g* of the bent portion 81*b* after being bent overlap with each other in a side view. In other words, the portion 81*f* of the bent portion 81*b* before being bent and the portion 81*g* of the bent portion 81*b* after being bent are aligned in the width direction. The bent portion 81*b* is bent back near a front end of the engine 5. The bent portion 81*b* is preferably U-shaped or substantially U-shaped.

An upstream portion of the increased diameter portion 81*c* in the flow direction of the exhaust gas is connected to the bent portion 81*b*. A downstream portion of the increased diameter portion 81*c* in the flow direction of the exhaust gas is connected to the catalyst storage 82. The increased diameter portion 81*c* has a sectional area that gradually increases downstream in the flow direction of the exhaust gas.

The catalyst storage 82 stores the catalyst member 82*a*. The catalyst member 82*a* is preferably a columnar member having a honeycomb structure, for example, and a catalyst is supported thereon. The catalyst member 82*a* is fitted into and fixed to the catalyst storage 82, for example. The catalyst supported on the catalyst member 82*a* efficiently reacts with the components contained in the exhaust gas at a catalytic activation temperature or higher. In order not to decrease the temperature of the exhaust gas that reaches the catalyst member 82*a* to less than the catalytic activation temperature, the catalyst member 82*a* is located in a vicinity of the exhaust ports 56*b* of the engine 5. Specifically, the catalyst member 82*a* is located such that the length of a flow passage for the exhaust gas from an exhaust port 56*b* closest to the catalyst member 82*a* to a front end of the catalyst member 82*a* is not more than about 500 mm, for example.

The second exhaust pipe 83 includes a decreased diameter portion 83*a* and a straight pipe 83*b*. An upstream portion of the decreased diameter portion 83*a* in the flow direction of the exhaust gas is connected to the catalyst storage 82. A downstream portion of the decreased diameter portion 83*a* in the flow direction of the exhaust gas is connected to the straight pipe 83*b*. The decreased diameter portion 83*a* has a sectional area that gradually decreases downstream in the flow direction of the exhaust gas. An upstream portion of the straight pipe 83*b* in the flow direction of the exhaust gas is connected to the decreased diameter portion 83*a*. A downstream portion of the straight pipe 83*b* in the flow direction of the exhaust gas is connected to the water lock 84.

According to a preferred embodiment of the present invention, the first exhaust pipe 81, the catalyst storage 82, the second exhaust pipe 83, and the water lock 84 are located outward (left) in the width direction with respect to the exhaust ports 56*b* of the engine 5 in a plan view. The term "outward in the width direction" denotes a direction spaced from the center of the engine 5 in the width direction. The first exhaust pipe 81, the catalyst storage 82, and the second exhaust pipe 83 overlap with the side surface 5*a* of the engine 5 in the side view. Specifically, the first exhaust pipe 81 (the entirety of the lead-out portion 81*a*, the bent portion 81*b*, and the increased diameter portion 81*c*) and the catalyst storage 82 totally overlap with the side surface 5*a* of the engine 5 in the side view. The second exhaust pipe 83 (the decreased diameter portion 83*a* and the straight pipe 83*b*) partially overlaps with the side surface 5*a* of the engine 5 in the side view.

The catalyst storage 82 is located rearward relative to the front end of the engine 5 and forward relative to a back end of the engine 5. Specifically, the catalyst storage 82 is located forward relative to a back end of a rearward most exhaust port 56*b* of the plurality of exhaust ports 56*b* and rearward relative to a front end of the forward most exhaust port 56*b* of the plurality of exhaust ports 56*b*. In other words, the catalyst storage 82 is located between the rearward most exhaust port 56*b* of the plurality of exhaust ports 56*b* and the forward most exhaust port 56*b* of the plurality of exhaust ports 56*b* in the front-back direction.

An upper end of the first exhaust pipe 81, an upper end of the catalyst storage 82, an upper end of the second exhaust pipe 83, and an upper end of the water lock 84 are located below an upper end of the engine 5 in the side view. A lower end of the first exhaust pipe 81, a lower end of the catalyst storage 82, a lower end of the second exhaust pipe 83, and a lower end of the water lock 84 are located above a lower end of the engine 5 in the side view.

According to a preferred embodiment of the present invention, the catalyst storage 82 is integral and unitary with the first exhaust pipe 81. Specifically, the first exhaust pipe 81 and the catalyst storage 82 are, for example, cast as an integral and unitary structure. Therefore, in the first exhaust pipe 81, the lead-out portion 81*a*, the bent portion 81*b*, and the increased diameter portion 81*c* are, for example, cast together. Thus, no connecting member to connect the lead-out portion 81*a*, the bent portion 81*b*, and the increased diameter portion 81*c* to each other is required, and no connecting member to connect the first exhaust pipe 81 and the catalyst storage 82 to each other is required. The first exhaust pipe 81 and the catalyst storage 82 are preferably cast from metal such as aluminum.

The lead-out portion 81*a* of the first exhaust pipe 81 and the catalyst storage 82 are aligned in the right-left direction, in this order, from the right in the plan view. The catalyst storage 82 overlaps with the trunk 81*e* of the lead-out portion 81*a* of the first exhaust pipe 81 in the side view.

Figure 4:
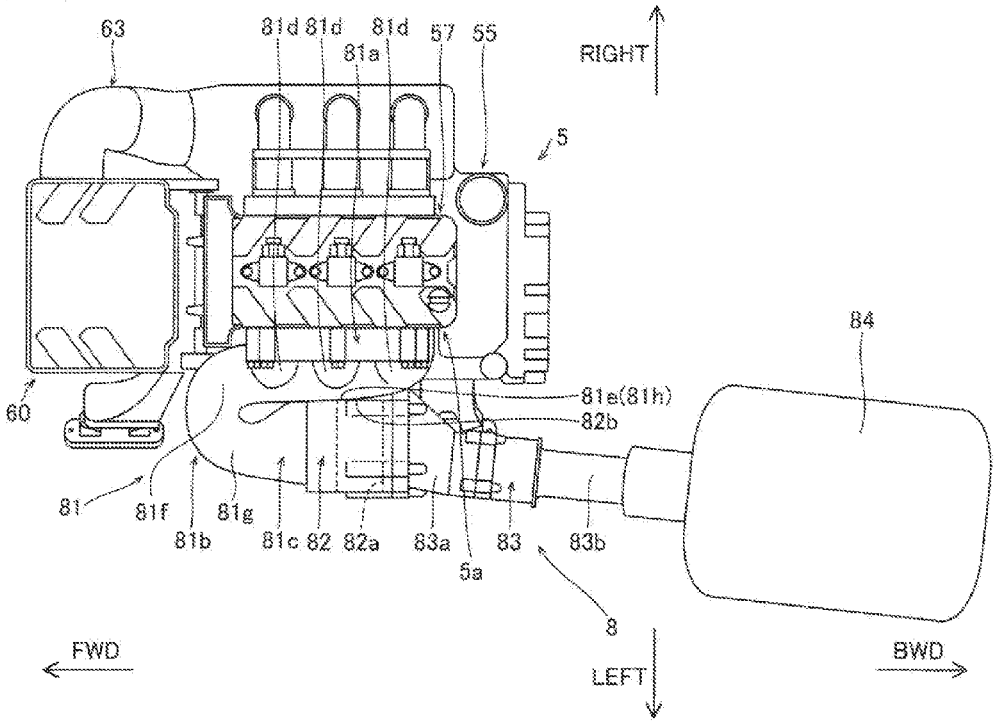
FIG. 4 is a plan view showing an engine of a jet propelled watercraft according to a preferred embodiment of the present invention.
Figure 5:
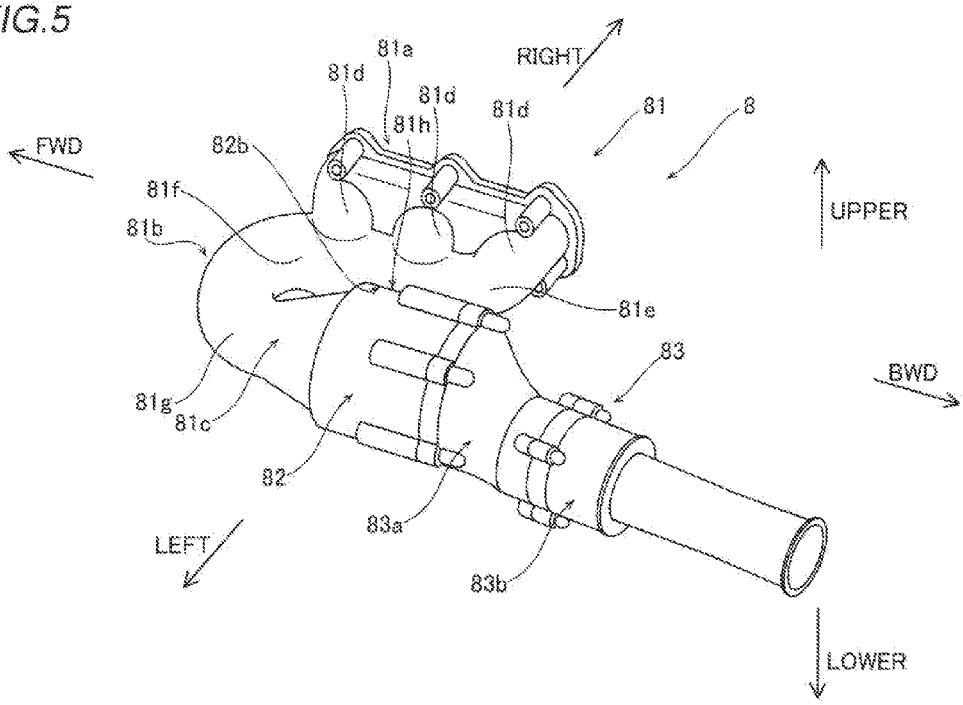
FIG. 5 is a perspective view showing a first exhaust pipe, a catalyst storage, and a second exhaust pipe of a jet propelled watercraft according to a preferred embodiment of the present invention.
Figure 7:
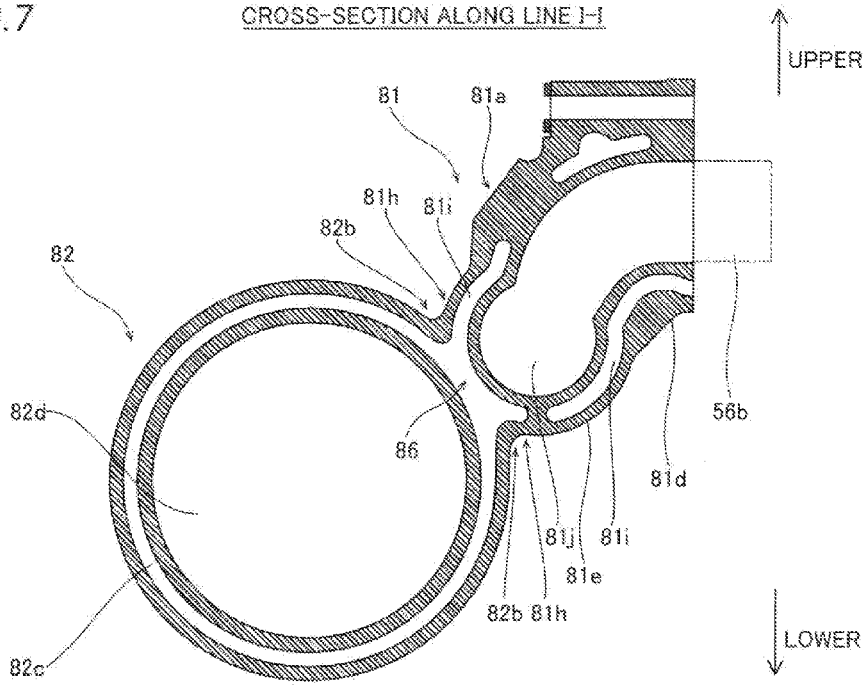
FIG. 7 is a sectional view taken along the line I-I shown in FIG. 6.

As shown in FIGS. 4, 5, and 7, a portion 82*b* (i.e., a right portion of the catalyst storage 82) of a side surface of the catalyst storage 82 and a portion 81*h* (i.e., a left portion of the trunk 81*e* of the first exhaust pipe 81) of a side surface of the first exhaust pipe 81 are integral and unitary with each other. Specifically, the right portion 82*b* of the catalyst storage 82 and the left portion 81*h* of the trunk 81*e* of the first exhaust pipe 81 are, for example, cast as an integral and unitary structure.

Figure 6:
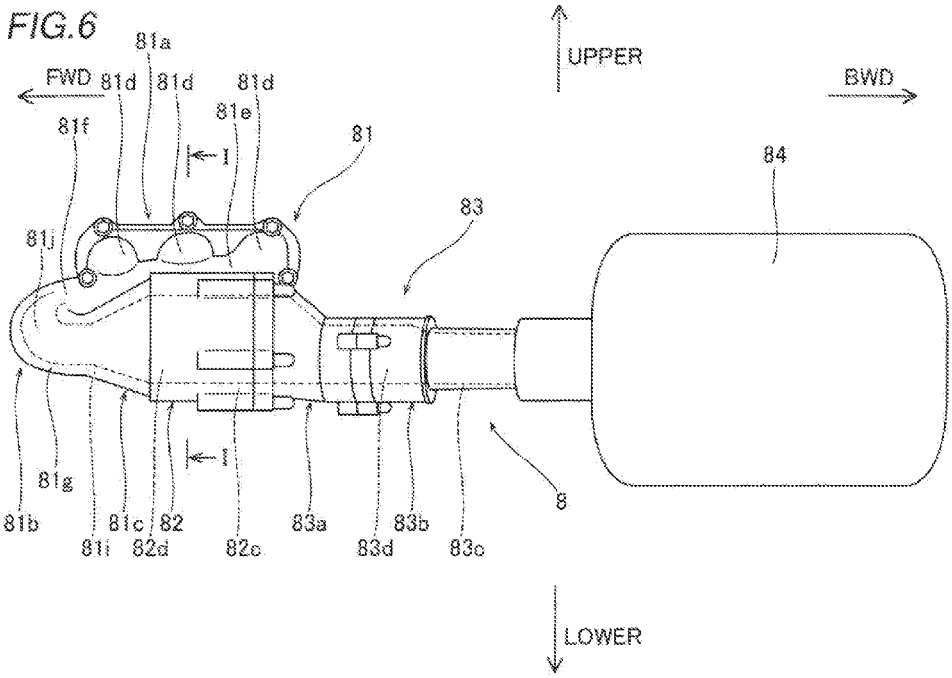
FIG. 6 is a side elevational view showing the first exhaust pipe, the catalyst storage, the second exhaust pipe, and a water lock of a jet propelled watercraft according to a preferred embodiment of the present invention.

As shown in FIGS. 6 and 7, the first exhaust pipe 81 includes a cooling water passage 81*i*. Water flows through the cooling water passage 81*i* to cool the first exhaust pipe 81. The cooling water passage 81*i* is integral and unitary with the first exhaust pipe 81. Specifically, the cooling water passage 81*i* is, for example, cast as a portion of the first exhaust pipe 81. The cooling water passage 81*i* surrounds an exhaust gas passage 81*j* of the first exhaust pipe 81.

The catalyst storage 82 includes a cooling water passage 82*c*. Water flows through the cooling water passage 82*c* to cool the catalyst storage 82 and the catalyst member 82*a* of the catalyst storage 82. The cooling water passage 82*c* is integral and unitary with the catalyst storage 82. Specifically, the cooling water passage 82*c* is, for example, cast as a portion of the catalyst storage 82. The cooling water passage 82*c* surrounds an exhaust gas passage 82*d* of the catalyst storage 82.

As shown in FIG. 7, at least a portion of the cooling water passage 81*i* of the first exhaust pipe 81 and at least a portion of the cooling water passage 82*c* of the catalyst storage 82 share and define a common cooling water passage 86. The common cooling water passage 86 is provided in a region in which the right portion 82*b* of the catalyst storage 82 and the left portion 81*h* of the trunk 81*e* of the first exhaust pipe 81 are integral and unitary with each other.

As shown in FIG. 6, the second exhaust pipe 83 includes a cooling water passage 83*c*. Water flows through the cooling water passage 83*c* to cool the second exhaust pipe 83. The cooling water passage 83*c* surrounds an exhaust gas passage 83*d* of the second exhaust pipe 83.

According to a preferred embodiment of the present invention, the exhaust passage 8 is provided such that an exhaust gas passage from the first exhaust pipe 81 to the water lock 84 has no rising slope, as shown in FIGS. 6 and 7. Thus, a bottom of the exhaust gas passage 81*j* of the first exhaust pipe 81 is located below the exhaust ports 56*b*. A bottom of the exhaust gas passage 82*d* of the catalyst storage 82 is located at the same or substantially the same height as the bottom of the exhaust gas passage 81*j* of the first exhaust pipe 81. A bottom of the exhaust gas passage 83*d* of the second exhaust pipe 83 is located at the same or substantially the same height as the bottom of the exhaust gas passage 82*d* of the catalyst storage 82. A bottom of an exhaust gas passage of the water lock 84 is located at the same or substantially the same height as the bottom of the exhaust gas passage 83*d* of the second exhaust pipe 83.

More specifically, a bottom of the exhaust gas passage 81*j* of the lead-out portion 81*a* of the first exhaust pipe 81 is located below the exhaust ports 56*b*. A bottom of the exhaust gas passage 81*j* of the bent portion 81*b* of the first exhaust pipe 81 is located below the bottom of the exhaust gas passage 81*j* of the lead-out portion 81*a*. A bottom of the exhaust gas passage 81*j* of the increased diameter portion 81*c* of the first exhaust pipe 81 is located below the bottom of the exhaust gas passage 81*j* of the bent portion 81*b*.

The bottom of the exhaust gas passage 82*d* of the catalyst storage 82 is located at the same or substantially the same height as the bottom of the exhaust gas passage 81*j* of the increased diameter portion 81*c*. A bottom of the exhaust gas passage 83*d* of the decreased diameter portion 83*a* of the second exhaust pipe 83 is located at the same or substantially the same height as the bottom of the exhaust gas passage 82*d* of the catalyst storage 82. A bottom of the exhaust gas passage 83*d* of the straight pipe 83*b* of the second exhaust pipe 83 is located at the same or substantially the same height as the bottom of the exhaust gas passage 83*d* of the decreased diameter portion 83*a* of the second exhaust pipe 83. The bottom of the exhaust gas passage of the water lock 84 is located below the bottom of the exhaust gas passage 83*d* of the straight pipe 83*b* of the second exhaust pipe 83.

According to various preferred embodiments of the present invention, the following advantageous effects are obtained.

According to a preferred embodiment of the present invention, the catalyst storage 82 and the water lock 84 are located outward in the width direction with respect to the exhaust ports 56*b* of the engine 5 in the plan view. Thus, both the catalyst storage 82 and the water lock 84 are located only on one side in the width direction of the watercraft body 2 with respect to the engine 5 (outward in the width direction with respect to the exhaust ports 56*b*). Consequently, the size in the width direction of a region in which the engine 5, the catalyst storage 82, and the water lock 84 are located is reduced as compared with the case where the catalyst storage 82 and the water lock 84 are located on both sides in the width direction with respect to the engine 5, respectively, and hence an increase in the size of the watercraft body 2 in the width direction is significantly reduced or prevented. Furthermore, the catalyst storage 82 and the water lock 84 are located on one side in the width direction of the watercraft body 2 with respect to the engine 5 (outward in the width direction with respect to the exhaust ports 56*b*), and hence the length of the exhaust pipe (second exhaust pipe 83) that connects the catalyst storage 82 to the water lock 84 is reduced as compared with the case where the catalyst storage 82 and the water lock 84 are located on both sides in the width direction with respect to the engine 5, respectively. Consequently, an increase in the weight of the exhaust pipe (second exhaust pipe 83) that connects the catalyst storage 82 to the water lock 84 is significantly reduced or prevented. Thus, an increase in the weight of the watercraft body 2 is significantly reduced or prevented.

According to a preferred embodiment of the present invention, the catalyst storage 82 overlaps with the side surface 5*a* of the engine 5 in the side view. Thus, an increase in the size of the watercraft body 2 in the vertical direction or the longitudinal direction is significantly reduced or prevented as compared with the case where the catalyst storage 82 is totally outside of the side surface 5*a* of the engine 5 in the side view. Furthermore, the catalyst storage 82 is located closer to the exhaust ports 56*b* as compared with the case where the catalyst storage 82 is totally outside of the side surface 5*a* of the engine 5 in the side view. Consequently, the length of the exhaust pipe (first exhaust pipe 81) that connects the exhaust ports 56*b* to the catalyst storage 82 is reduced. Thus, an increase in the weight of the exhaust pipe (first exhaust pipe 81) that connects the exhaust ports 56*b* to the catalyst storage 82 is significantly reduced or prevented, and hence an increase in the weight of the watercraft body 2 is significantly reduced or prevented.

According to a preferred embodiment of the present invention, the first exhaust pipe 81 and the second exhaust pipe 83 overlap with the side surface 5*a* of the engine 5 in the side view. Thus, in addition to the catalyst storage 82, the first exhaust pipe 81 and the second exhaust pipe 83 overlap with the side surface 5*a* of the engine 5 in the side view, and hence an increase in the size of the watercraft body 2 in the vertical direction or the longitudinal direction is effectively significantly reduced or prevented.

According to a preferred embodiment of the present invention, the catalyst storage 82 is located forward relative to a back end of the rearward most exhaust port 56*b* of the plurality of exhaust ports 56*b* and rearward relative to a front end of the forward most exhaust port 56*b* of the plurality of exhaust ports 56*b*. Thus, the catalyst storage 82 is located close to the exhaust ports 56*b*. Consequently, the length of the exhaust pipe (first exhaust pipe 81) that connects the exhaust ports 56*b* to the catalyst storage 82 is further reduced such that an increase in the weight of the exhaust pipe (first exhaust pipe 81) that connects the exhaust ports 56*b* to the catalyst storage 82 is further significantly reduced or prevented. Consequently, an increase in the weight of the watercraft body 2 is further significantly reduced or prevented.

According to a preferred embodiment of the present invention, the bent portion 81*b* that extends forward of the exhaust ports 56*b*, is bent back, and extends rearward is provided in the first exhaust pipe 81. Thus, the first exhaust pipe 81 extends forward and thereafter extends rearward due to the bent portion 81*b*, and hence the first exhaust pipe 81 and the catalyst storage 82 are connected to each other at a position that is farther forward as compared with the case where the first exhaust pipe 81 extends only rearward of the exhaust ports 56*b*. Consequently, the catalyst storage 82 is located at a more forward position, and hence the catalyst storage 82 is easily located at a position at which the catalyst storage 82 overlaps with the side surface 5*a* of the engine 5.

According to a preferred embodiment of the present invention, the bent portion 81*b* of the first exhaust pipe 81 extends forward of the forward most exhaust port 56*b* of the plurality of exhaust ports 56*b*, is bent back, and extends rearward. Thus, even in a structure in which the plurality of exhaust ports 56*b* are provided on the side surface 5*a* of the engine 5, the catalyst storage 82 is located forward such that the catalyst storage 82 is easily located at the position at which the catalyst storage 82 overlaps with the side surface 5*a* of the engine 5.

According to a preferred embodiment of the present invention, the bent portion 81*b* overlaps with the side surface 5*a* of the engine 5 in the side view. Thus, the bent portion 81*b* is provided such that an increase in the size of the watercraft body 2 in the vertical direction or the longitudinal direction is significantly reduced or prevented.

According to a preferred embodiment of the present invention, the bent portion 81*b* is bent back near the front end of the engine 5. Thus, the length of the bent portion 81*b* of the first exhaust pipe 81 is reduced as compared with the case where the bent portion 81*b* of the first exhaust pipe 81 is bent back at a forward position relative to the front end of the engine 5. Consequently, an increase in the weight of the first exhaust pipe 81 is significantly reduced or prevented. Thus, an increase in the weight of the watercraft body 2 is significantly reduced or prevented.

According to a preferred embodiment of the present invention, the portion 81*f* of the bent portion 81*b* before being bent and the portion 81*g* of the bent portion 81*b* after being bent overlap with each other in the side view. Thus, the portion 81*f* of the bent portion 81*b* before being bent and the portion 81*g* of the bent portion 81*b* after being bent are located close to each other, and hence the length of the bent portion 81*b* is reduced. Consequently, an increase in the weight of the first exhaust pipe 81 is significantly reduced or prevented. Thus, an increase in the weight of the watercraft body 2 is significantly reduced or prevented.

According to a preferred embodiment of the present invention, the lead-out portion 81*a* that connects the exhaust ports 56*b* of the engine 5 to the bent portion 81*b* and the increased diameter portion 81*c* that connects the bent portion 81*b* to the catalyst storage 82 are provided in the first exhaust pipe 81. Furthermore, the lead-out portion 81*a*, the bent portion 81*b*, and the increased diameter portion 81*c* are integral and unitary with each other. Thus, the number of components of the exhaust passage 8 is reduced as compared with the case where at least one of the lead-out portion 81*a*, the bent portion 81*b*, and the increased diameter portion 81*c* is separately provided. Consequently, the structure of the exhaust passage 8 is simplified.

According to a preferred embodiment of the present invention, the catalyst storage 82 is integral and unitary with the first exhaust pipe 81. Thus, the number of components of the exhaust passage 8 is reduced as compared with the case where the catalyst storage 82 is provided separately from the first exhaust pipe 81. Consequently, the structure of the exhaust passage 8 is simplified.

According to a preferred embodiment of the present invention, the bottom of the exhaust gas passage 81*j* of the first exhaust pipe 81 is located below the exhaust ports 56*b*. Thus, when moisture in the exhaust gas is condensed to generate condensed water, accumulation of the condensed water between the exhaust ports 56*b* and the first exhaust pipe 81 is significantly reduced or prevented. Consequently, blockage of exhaust gas flow caused by the accumulation of the condensed water is significantly reduced or prevented.

According to a preferred embodiment of the present invention, the bottom of the exhaust gas passage 82*d* of the catalyst storage 82 is located at the same or substantially the same height as the bottom of the exhaust gas passage 81*j* of the first exhaust pipe 81. Furthermore, the bottom of the exhaust gas passage 83*d* of the second exhaust pipe 83 is located at the same or substantially the same height as the bottom of the exhaust gas passage 82*d* of the catalyst storage 82. In addition, the bottom of the exhaust gas passage of the water lock 84 is located at the same or substantially the same height as the bottom of the exhaust gas passage 83*d* of the second exhaust pipe 83. Thus, a rising slope in the exhaust passage 8 from the exhaust ports 56*b* to the water lock 84 is significantly reduced or prevented. Consequently, accumulation of the condensed water between the exhaust ports 56*b* and the water lock 84 is significantly reduced or prevented. Thus, blockage of the exhaust gas flow caused by the accumulation of the condensed water is significantly reduced or prevented. Furthermore, a degradation of the performance of the catalyst in the catalyst storage 82 caused by a decrease in the temperature of the catalyst resulting from the accumulation of the condensed water is significantly reduced or prevented.

According to a preferred embodiment of the present invention, the upper end of the catalyst storage 82 and the upper end of the water lock 84 are located below the upper end of the engine 5 in the side view. Furthermore, the lower end of the catalyst storage 82 and the lower end of the water lock 84 are located above the lower end of the engine 5 in the side view. Thus, an increase in the size of the watercraft body 2 in the vertical direction is significantly reduced or prevented as compared with the case where the upper ends of the catalyst storage 82 and the water lock 84 are located below the lower end of the engine 5 or the lower ends of the catalyst storage 82 and the water lock 84 are located above the upper end of the engine 5.

According to a preferred embodiment of the present invention, the catalyst storage 82 overlaps with the first exhaust pipe 81 in the side view. Thus, the catalyst storage 82 and the first exhaust pipe 81 are located close to each other, and hence the length of the first exhaust pipe 81 is reduced. Consequently, an increase in the weight of the first exhaust pipe 81 is significantly reduced or prevented. Thus, an increase in the weight of the watercraft body 2 is significantly reduced or prevented.

According to a preferred embodiment of the present invention, the portion 82*b* of the side surface of the catalyst storage 82 and the portion 81*h* of the side surface of the first exhaust pipe 81 are integral and unitary with each other. Thus, the catalyst storage 82 is located close to the exhaust ports 56*b*, and hence an increase in the size of the watercraft body 2 in the width direction is further significantly reduced or prevented. Furthermore, according to a preferred embodiment of the present invention, the catalyst storage 82 and the first exhaust pipe 81 are located close to each other, and hence the length of the first exhaust pipe 81 is further reduced such that an increase in the weight of the first exhaust pipe 81 is further significantly reduced or prevented. Consequently, an increase in the weight of the watercraft body 2 is further significantly reduced or prevented.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the engine preferably includes the plurality of (for example, three) exhaust ports in a preferred embodiment described above, the present invention is not restricted to this. According to a preferred embodiment of the present invention, the engine may alternatively include one exhaust port or a number of exhaust ports other than three.

While the engine is preferably an in-line engine in a preferred embodiment described above, the present invention is not restricted to this. According to a preferred embodiment of the present invention, the engine may alternatively be a V-type engine, or an engine other than an in-line engine and a V-type engine.

While the first exhaust pipe preferably totally overlaps with the side surface of the engine in the side view in a preferred embodiment described above, the present invention is not restricted to this. According to a preferred embodiment of the present invention, the first exhaust pipe may not totally overlap with the side surface of the engine in the side view. In other words, the first exhaust pipe may partially overlap with the side surface of the engine in the side view.

While the catalyst storage preferably totally overlaps with the side surface of the engine in the side view in a preferred embodiment described above, the present invention is not restricted to this. According to a preferred embodiment of the present invention, the catalyst storage may not totally overlap with the side surface of the engine in the side view. In other words, the catalyst storage may only partially overlap with the side surface of the engine in the side view.

While the second exhaust pipe preferably partially overlaps with the side surface of the engine in the side view in a preferred embodiment described above, the present invention is not restricted to this. According to a preferred embodiment of the present invention, the second exhaust pipe may alternatively totally overlap with the side surface of the engine in the side view, or the second exhaust pipe may not overlap with the side surface of the engine in the side view.

While the catalyst storage is preferably located forward relative to the rearward most exhaust port of the plurality of exhaust ports and rearward relative to the forward most exhaust port of the plurality of exhaust ports in a preferred embodiment described above, the present invention is not restricted to this. According to a preferred embodiment of the present invention, the catalyst storage may not be located forward relative to the rearward most exhaust port of the plurality of exhaust ports and rearward relative to the forward most exhaust port of the plurality of exhaust ports so far as the catalyst storage overlaps with the engine in the side view.

While the first exhaust pipe and the catalyst storage are preferably integral and unitary with each other in a preferred embodiment described above, the present invention is not restricted to this. According to a preferred embodiment of the present invention, the first exhaust pipe and the catalyst storage may alternatively be provided separately from each other. When the first exhaust pipe and the catalyst storage are provided separately from each other, the first exhaust pipe and the catalyst storage may be connected to each other by a connecting member such as a bolt, for example. Alternatively, the first exhaust pipe, the catalyst storage, and the second exhaust pipe may be connected to each other by clamping the catalyst storage between the first exhaust pipe and the second exhaust pipe.

While the first exhaust pipe preferably includes the lead-out portion, the bent portion, and the increased diameter portion, and the lead-out portion, the bent portion, and the increased diameter portion are preferably integral and unitary with each other in a preferred embodiment described above, the present invention is not restricted to this. According to a preferred embodiment of the present invention, the lead-out portion, the bent portion, and the increased diameter portion may not be integral and unitary with each other. For example, the lead-out portion and the bent portion may be integral and unitary with each other, and the increased diameter portion may be separately provided. Alternatively, the lead-out portion, the bent portion, and the increased diameter portion may be provided separately from each other. When the lead-out portion, the bent portion, and the increased diameter portion are provided separately from each other, the lead-out portion, the bent portion, and the increased diameter portion may be connected to each other by connecting members such as bolts, for example.

While the first exhaust pipe preferably includes the lead-out portion, the bent portion, and the increased diameter portion in a preferred embodiment described above, the present invention is not restricted to this. According to a preferred embodiment of the present invention, the first exhaust pipe may not include the bent portion and the increased diameter portion so far as the same includes the lead-out portion connected to the exhaust ports. For example, the first exhaust pipe may include the lead-out portion and the bent portion without including the increased diameter portion, or may include the lead-out portion and the increased diameter portion without including the bent portion. Alternatively, the first exhaust pipe may include only the lead-out portion.

While the portion (i.e., the right portion of the catalyst storage) of the side surface of the catalyst storage and the portion (i.e., the left portion of the trunk of the first exhaust pipe) of the side surface of the first exhaust pipe are preferably integral and unitary with each other in a preferred embodiment described above, the present invention is not restricted to this. According to a preferred embodiment of the present invention, the side surface of the catalyst storage and the side surface of the first exhaust pipe may not be integral and unitary with each other, but may be separate from each other.

While the bottom of the exhaust gas passage of the catalyst storage is preferably located at the same or substantially the same height as the bottom of the exhaust gas passage of the first exhaust pipe, the bottom of the exhaust gas passage of the second exhaust pipe is preferably located at the same or substantially the same height as the bottom of the exhaust gas passage of the catalyst storage, and the bottom of the exhaust gas passage of the water lock is preferably located at the same or substantially the same height as the bottom of the exhaust gas passage of the second exhaust pipe in a preferred embodiment described above, the present invention is not restricted to this. According to a preferred embodiment of the present invention, the bottom of the exhaust gas passage of the catalyst storage may alternatively be located below the bottom of the exhaust gas passage of the first exhaust pipe. Furthermore, the bottom of the exhaust gas passage of the second exhaust pipe may alternatively be located below the bottom of the exhaust gas passage of the catalyst storage. In addition, the bottom of the exhaust gas passage of the water lock may alternatively be located below the bottom of the exhaust gas passage of the second exhaust pipe.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:

a watercraft body;

an engine housed in the watercraft body and provided with an exhaust port on a side surface in a width direction that is perpendicular to a longitudinal direction of the watercraft body;

a first exhaust pipe connected to the exhaust port;

a catalyst storage connected to the first exhaust pipe;

a second exhaust pipe connected to the catalyst storage; and a water lock connected to the second exhaust pipe; wherein the catalyst storage overlaps with the side surface of the engine in a side view of the jet propelled watercraft;

the catalyst storage and the water lock are located outward in the width direction with respect to the exhaust port of the engine in a plan view of the jet propelled watercraft; and the first exhaust pipe and the second exhaust pipe overlap with the side surface of the engine in the side view.

2. A jet propelled watercraft comprising:

a watercraft body;

an engine housed in the watercraft body and provided with an exhaust port on a side surface in a width direction that is perpendicular to a longitudinal direction of the watercraft body;

a first exhaust pipe connected to the exhaust port;

a catalyst storage connected to the first exhaust pipe;

a second exhaust pipe connected to the catalyst storage; and a water lock connected to the second exhaust pipe; wherein the catalyst storage overlaps with the side surface of the engine in a side view of the jet propelled watercraft;

the catalyst storage and the water lock are located outward in the width direction with respect to the exhaust port of the engine in a plan view of the jet propelled watercraft;

the exhaust port includes a plurality of exhaust ports provided on the side surface of the engine; and the catalyst storage is located forward relative to a back end of a rearward most exhaust port of the plurality of exhaust ports and rearward relative to a front end of a forward most exhaust port of the plurality of exhaust ports.

3. The jet propelled watercraft according to claim 1, wherein the first exhaust pipe includes a bent portion that extends forward of the exhaust port, is bent back, and extends rearward.

4. The jet propelled watercraft according to claim 3, wherein the exhaust port includes a plurality of exhaust ports provided on the side surface of the engine; and the bent portion of the first exhaust pipe extends forward of a forward most exhaust port of the plurality of exhaust ports, is bent back, and extends rearward.

5. The jet propelled watercraft according to claim 3, wherein the bent portion overlaps with the side surface of the engine in the side view.

6. The jet propelled watercraft according to claim 3, wherein the bent portion is bent back close to a front end of the engine.

7. The jet propelled watercraft according to claim 3, wherein a portion of the bent portion before being bent and a portion of the bent portion after being bent overlap with each other in the side view.

8. The jet propelled watercraft according to claim 3, wherein the first exhaust pipe further includes a lead-out portion that connects the exhaust port of the engine to the bent portion and an increased diameter portion that connects the bent portion to the catalyst storage; and the lead-out portion, the bent portion, and the increased diameter portion are integral and unitary with each other.

9. The jet propelled watercraft according to claim 1, wherein the catalyst storage is integral and unitary with the first exhaust pipe.

10. The jet propelled watercraft according to claim 1, wherein a bottom of an exhaust gas passage of the first exhaust pipe is located below the exhaust port.

11. The jet propelled watercraft according to claim 10, wherein a bottom of an exhaust gas passage of the catalyst storage is located at a same or substantially a same height as the bottom of the exhaust gas passage of the first exhaust pipe or is located below the bottom of the exhaust gas passage of the first exhaust pipe;

a bottom of an exhaust gas passage of the second exhaust pipe is located at a same or substantially a same height as the bottom of the exhaust gas passage of the catalyst storage or is located below the bottom of the exhaust gas passage of the catalyst storage; and a bottom of an exhaust gas passage of the water lock is located at a same or substantially a same height as the bottom of the exhaust gas passage of the second exhaust pipe or is located below the bottom of the exhaust gas passage of the second exhaust pipe.

12. The jet propelled watercraft according to claim 1, wherein an upper end of the catalyst storage and an upper end of the water lock are located below an upper end of the engine in the side view; and a lower end of the catalyst storage and a lower end of the water lock are located above a lower end of the engine in the side view.

13. The jet propelled watercraft according to claim 1, wherein the catalyst storage overlaps with the first exhaust pipe in the side view.

14. The jet propelled watercraft according to claim 13, wherein a portion of a side surface of the catalyst storage and a portion of a side surface of the first exhaust pipe are integral and unitary with each other.

15. A jet propulsion assembly comprising:

an engine housed in a watercraft body and provided with an exhaust port on a side surface in a width direction that is perpendicular to a longitudinal direction of the watercraft body;

a first exhaust pipe connected to the exhaust port;

a catalyst storage connected to the first exhaust pipe;

a second exhaust pipe connected to the catalyst storage; and a water lock connected to the second exhaust pipe; wherein the catalyst storage overlaps with the side surface of the engine in a side view of the jet propulsion assembly;

the catalyst storage and the water lock are located outward in the width direction with respect to the exhaust port of the engine in a plan view of the jet propulsion assembly; and the first exhaust pipe and the second exhaust pipe overlap with the side surface of the engine in the side view.

16. A jet propulsion assembly comprising:

an engine housed in a watercraft body and provided with an exhaust port on a side surface in a width direction that is perpendicular to a longitudinal direction of the watercraft body;

a first exhaust pipe connected to the exhaust port;

a catalyst storage connected to the first exhaust pipe;

a second exhaust pipe connected to the catalyst storage; and a water lock connected to the second exhaust pipe; wherein the catalyst storage overlaps with the side surface of the engine in a side view of the jet propulsion assembly;

the catalyst storage and the water lock are located outward in the width direction with respect to the exhaust port of the engine in a plan view of the jet propulsion assembly;

the exhaust port includes a plurality of exhaust ports provided on the side surface of the engine; and the catalyst storage is located forward relative to a back end of a rearward most exhaust port of the plurality of exhaust ports and rearward relative to a front end of a forward most exhaust port of the plurality of exhaust ports.

17. The jet propulsion assembly according to claim 15, wherein the first exhaust pipe includes a bent portion that extends forward of the exhaust port, is bent back, and extends rearward.

18. The jet propulsion assembly according to claim 17, wherein the exhaust port includes a plurality of exhaust ports provided on the side surface of the engine; and the bent portion of the first exhaust pipe extends forward of a forward most exhaust port of the plurality of exhaust ports, is bent back, and extends rearward.

* * * * *